US005312003A

United States Patent [19]

Domenig

[11] Patent Number: 5,312,003

[45] Date of Patent: May 17, 1994

[54] LAZY SUSAN SYSTEM

[75] Inventor: Georg Domenig, Kernersville, N.C.

[73] Assignee: Peter Meier, Inc., Kernersville, N.C.

[21] Appl. No.: 8,658

[22] Filed: Jan. 25, 1993

[51] Int. Cl.[5] ..... A47F 5/00

[52] U.S. Cl. ..... 211/144; 211/131

[58] Field of Search ..... 312/305, 311; 211/131, 211/163, 144; 108/94, 139, 140

[56] References Cited

U.S. PATENT DOCUMENTS 2,527,132 10/1950 Jackson et al. ..... 211/144 X
2,680,668 6/1954 Stanfiel et al. ..... 211/144 X
2,777,585 1/1957 Jorgensen ..... 211/144 X
2,840,438 6/1958 Sharpe ..... 211/144 X
4,738,495 4/1988 Mitts ..... 211/144 X

*Primary Examiner*—Alvin C. Chin-Shue

[57] ABSTRACT

An adjustable and alignable lazy susan system wherein the interior components are slidably mounted on and supported by a vertical tube and can be locked in the installed position or collapsed upon themselves at one end of the shaft and secured in that arrangement to avoid damage and misalignment during shipment.

3 Claims, 2 Drawing Sheets

LAZY SUSAN SYSTEM

BACKGROUND OF THE INVENTION

1. Field of the Invention

The present invention relates to lazy susan systems and more particularly to lazy susan systems whose shelves can be locked in the installed position or collapsed to avoid damage and conserve space during shipment.

2. Description of the Prior Art

Cabinets can, in many instances, be shipped in disassembled form and thereafter assembled at the installation site. In some instances, however, it is preferable to assemble the entire unit at the manufacturing location and ship it in essentially installed form thereafter because of the precision necessary to make the various components efficiently cooperate with each other. This is true of lazy susan assemblies, since on-site assembly usually lacks the efficiency associated with the manufacturing facility for such items.

While assembling cabinets such as lazy susans in their entirety at the factory is more efficient and results in a reliable cabinet assembly once final installation is made, there is a danger that some damage can be suffered by the assembly during shipment because the shelves may have a tendency to slide on the supporting shaft or rotate as the cargo is moved overland. Jolts, bumps or other irregular movements that affect the mechanism of such cabinets can result in inadvertent damage to the cabinet or its components.

The present invention is directed to a system that will minimize the likelihood of such damage during shipment by enabling the securement of shelves on the shaft or the collapse of the shelves within a lazy susan system upon themselves and thereafter anchoring the shelves in that position so that no movement can occur during shipment.

SUMMARY OF THE INVENTION

The purpose of the present invention is to provide a new lazy susan system to be utilized primarily during transportation of the assembled system to an installation site that has all of the advantages of prior art devices and none of the disadvantages.

Another object of the present invention is to provide a lazy susan system wherein the rotatable shelves and shelf supporting elements can be secured against sliding on the tube or collapsed upon themselves and anchored in that collapsed position during transportation of the system from the manufacturing site to the installation site.

Another object of the present invention is to provide a lazy susan system of the type described which can be totally assembled at the manufacturing site and collapsed thereafter to be shipped in the protectable state to avoid damage and misalignment.

The system includes a housing with top and bottom and a substantially vertical shaft positioned within the housing secured to the top and bottom and holding one or more rotating shelves or surfaces. Suitable means for supporting the shelves in a desired location are provided, and all of these components are releasably secured to the shaft so that they can be moved to, for example, the lower end of the shelf and secured in that arrangement to prevent damage or misalignment during shipment.

Thus, there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting. As such, those skilled in the art will appreciate that the concept upon which this disclosure is based may readily be utilized as a basis for designing other structures, methods, systems and in carrying out the several purposes of the present invention. It is important that the claims be regarded as including such equivalent methods and products resulting therefrom so long as they do not depart from the spirit and scope of the present invention. The application is neither intended to define the invention which is measured by its claims nor to limit its scope in any way.

For a better understanding of the invention, its operating advantages, and the specific results obtained by its use, reference should be made to the following detailed description taken in conjunction with the accompanying drawings wherein like characters of reference designate like parts throughout the several views.

DETAILED DESCRIPTION OF THE DISCLOSURES

Figure 1:
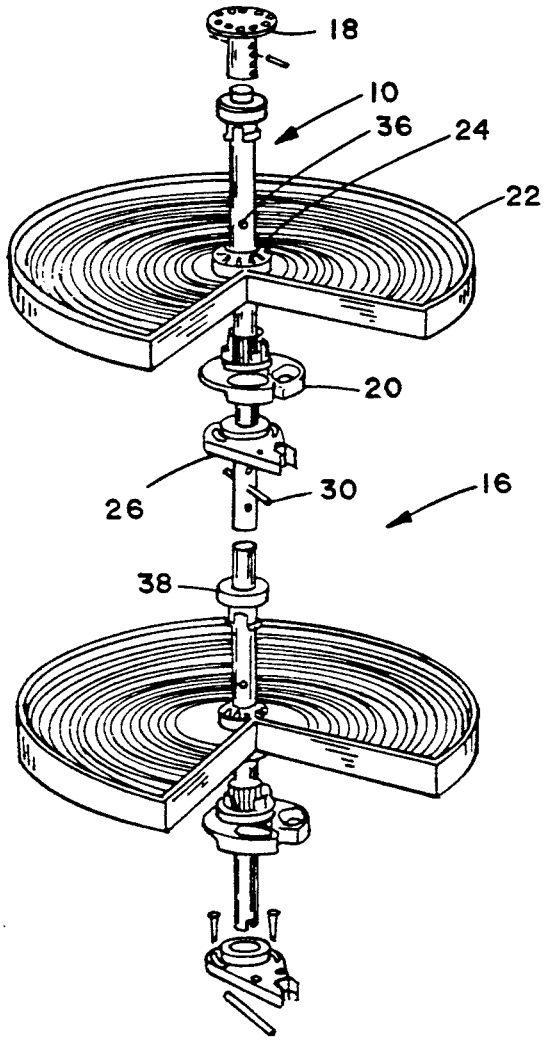
FIG. 1 is a perspective, fragmentary, partially exploded view of the vertical tube and its carried components of the lazy susan assembly comprising the present inventive concept.
Figure 2:
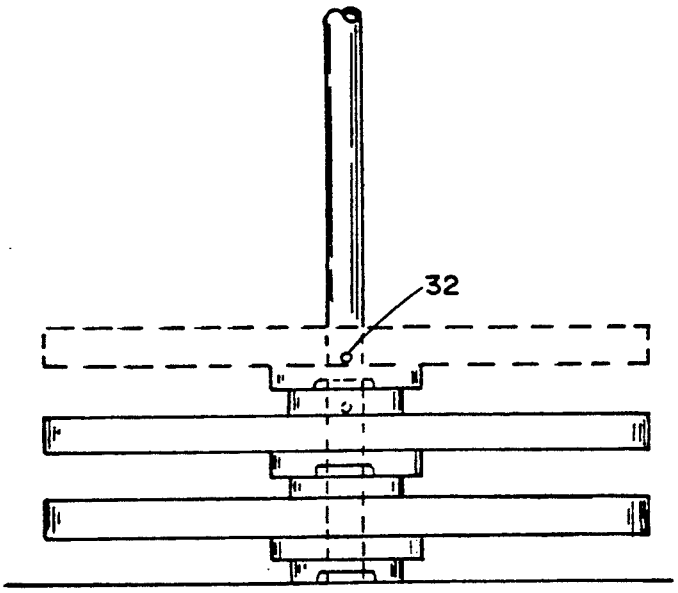
FIG. 2 is a side elevational, fragmentary and sectional view of the system shown in FIG. 1 in the collapsed condition.
Figure 3:
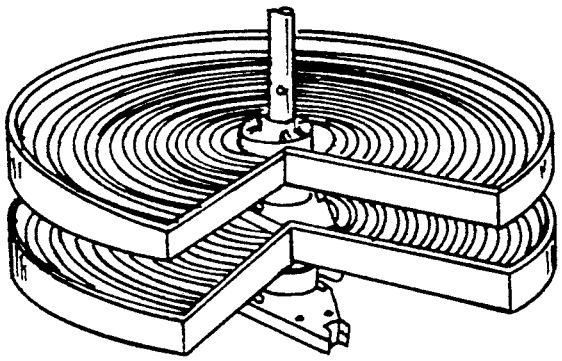
FIG. 3 is a perspective, fragmentary view of the collapsed assembly shown in FIG. 2.
Figure 4:
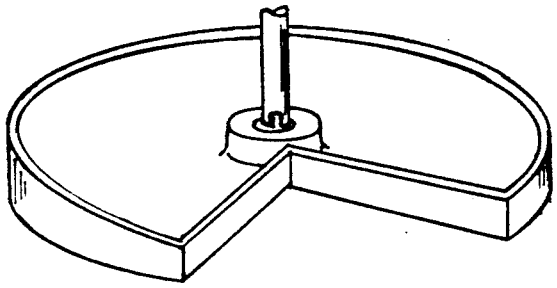
FIG. 4 is a perspective, fragmentary and exploded view of one shelf of a lazy susan mounted on a vertical tube and secured against sliding by a safety pin.

Referring now to the drawings, particularly to FIG. 1, a vertical shaft shown generally as 10 extends from the top 12 to the bottom 14 of a lazy susan housing cavity 16 and supports various elements to be subsequently described. A hub 18 is affixed to top 12 and holds rotatable tube 10 in a vertical position, and shaft 10 carries a shelf-engaging bracket 20 which cooperatively meshes with shelf 22 at its geared hub 24. A shelf supporting positioning plate 26 cooperatively engages the shelf engaging bracket 20 and by means of a pin is secured to hold shelf 22, bracket 20 and plate 26 in a fixed relationship with each other.

The shelf arrangement described can be repeated as many times as the space within the cavity of the housing will permit. The example shown in FIG. 1 accommodates two such shelves and their related components, and the collapsed system shows two shelves and a proposed third (in hidden lines).

Since all of the components of the assembly are slidably movable on vertical tube 10, it is advantageous to assemble the cabinet at the manufacturing site since the rotating shelves and their related components are best installed within the cabinet as it is being constructed, it being difficult to make such an installation at the installation site if the assembly is shipped in separate packaging because it will be in some instances necessary to disassemble the cabinet in order to install the rotating mechanism.

Once the cabinet and its related accessories have been assembled, it has been found desirable to place the internal components in an arrangement that will avoid rotation or movement of the shelves during shipment. To this end, pins 30 can be removed from the supporting plates 26 and the shelves and shelf-engaging brackets 20 moved downwardly to near the bottom 14 of the cabinet in an arrangement that will essentially have all components abutting each other so that a snug, unrotating and otherwise unmovable relationship is achieved. A pin 32 is then positioned just above shelf 22 to prevent the shelf and other components from sliding back up the tube once movement during transportation occurs. A safety pin 34, piece of tape or any other convenient mechanism can be utilized to prevent displacement of the pin from the aperture provided in the shaft for this purpose.

Figure 5:
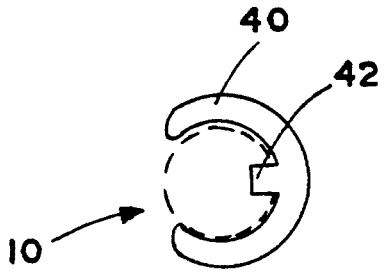
FIG. 5 is a plan view of the pin shown in FIG. 4 and its relationship with a shaft shown in hidden lines.

Alternatively, the shelves 22 can be secured against movement, particularly sliding on the tube, by the installation of pin 34 in an aperture 36 formed in tube 10 just above cap 38 which secures the top of shelf 22 in the rotating position. The preferred form of pin 34 is shown in FIG. 5 and includes an arcuate body portion 40 that flexibly encircles the majority of the exterior of tube 10 and an engaging element 42 formed in body 40 that cooperatively inserts in aperture 36 to hold the clip 34 in place and prevent the shelf 22 and its related elements from moving. Clip 34 is easily removable should there be a need to change the style of a shelf, reposition it along shaft 10, or repair a broken portion thereof.

If the collapsed shelf feature is utilized, it is a simple matter to remove the pin 34, tape, or other element, pull pin 32, and reposition the shelves 22 and their related components along the vertical tube 10 in their normal operating positions once installation is desired.

With respect to the present inventive concept, it is to be realized that the techniques involved in forming the novel combination set forth herein and the components associated therewith are unlimited and are deemed readily apparent and obvious to one skilled in the art. All equivalent relationships to those illustrated in the drawings and described in the specification are intended to be encompassed herein. Therefore, the following is considered as illustrative only of the principles of the invention. Further, since numerous modifications and changes will readily occur to those skilled in the art, it is not desired to limit the invention to the exact construction and operation shown and described. All suitable modifications and equivalents falling within the scope of the appended claims are deemed within the present inventive concept.

What is claimed is:

1. An adjustable and alignable lazy susan system having a top and a bottom comprising: a housing defining a cavity having upper and lower ends, the upper end closed by the cabinet top and lower ends closed by the cabinet bottom; a substantially vertical tube positioned within the cavity; an upper shaft-engaging bracket secured to the cabinet top closing the cavity end; one or more rotating shelves releasably secured to the vertical tube; means for positioning the rotatable shelves at preselected locations along the tube; and means for securing the shelves and the rotatable shelf positioning means to avoid a movement and displacement of the rotatable shelves during shipment, the positioning means including a self-supporting positioning plate and a plate securing pin.

2. The system as claimed in claim 1 wherein the positioning means includes an arcuate clip partially encircling the vertical tube and releaseably secured thereto.

3. The system as claimed in claim 2 wherein the tube has a prepositioned aperture, the arcuate clip has a resilient body portion encircling the tube, and the body portion has an engaging portion cooperatively received by the positioned aperture.

* * * * *